United States Patent [19]

Fairgrieve

[11] 4,299,065

[45] Nov. 10, 1981

[54] ACCOMMODATION UNITS

[75] Inventor: James M. Fairgrieve, Bromley, England

[73] Assignee: Sanders and Forster Limited, London, England

[21] Appl. No.: 15,873

[22] Filed: Feb. 27, 1979

[30] Foreign Application Priority Data

Feb. 28, 1978 [GB] United Kingdom ..... 7982/78
Mar. 2, 1978 [GB] United Kingdom ..... 8424/78

[51] Int. Cl.[3] ..... E04B 1/16; E04B 1/348

[52] U.S. Cl. ..... 52/79.7; 52/79.11; 52/79.13

[58] Field of Search ..... 52/79.13, 79.11, 79.7, 52/79.1

[56] References Cited

U.S. PATENT DOCUMENTS

| | | | |
|---|---|---|---|
| 3,229,431 | 1/1966 | Paul | 52/79.13 |
| 3,331,170 | 7/1967 | Lowe et al. | 52/79.11 |
| 3,500,595 | 3/1979 | Bennett | 52/79.13 |
| 3,751,864 | 8/1973 | Berger | 52/79.11 |
| 3,822,519 | 7/1974 | Antoniou | 52/79.13 |
| 3,824,750 | 7/1974 | Antoniou | 52/79.13 |
| 3,831,332 | 8/1974 | Weese | 52/79.11 |
| 3,971,172 | 7/1976 | Gentil | 52/79.9 X |
| 4,107,886 | 8/1978 | Ray et al. | 52/79.11 |

FOREIGN PATENT DOCUMENTS

| | | | |
|---|---|---|---|
| 753001 | 2/1967 | Canada | 52/79.1 |
| 2210342 | 9/1973 | Fed. Rep. of Germany | 52/79.11 |
| 1500966 | 10/1967 | France | 52/79.1 |
| 1520408 | 3/1968 | France | 52/79.13 |

*Primary Examiner*—Alfred C. Perham
*Attorney, Agent, or Firm*—Wenderoth, Lind & Ponack

[57] ABSTRACT

An accommodation unit to form, with a plurality of such units, a building, comprises a housing having corner posts, sidewalls, floor and ceiling panels, a window unit at one end and an end wall with a doorway at the other end. The housings are intended to be located side-by-side and stacked one on top of the other secured together at the corner posts.

Concrete is cast between the adjacent side walls of the housings and the outer faces of the side walls are formed with T-section ribs which key with the concrete to provide a composite rigid wall.

18 Claims, 12 Drawing Figures

FIG. 1.
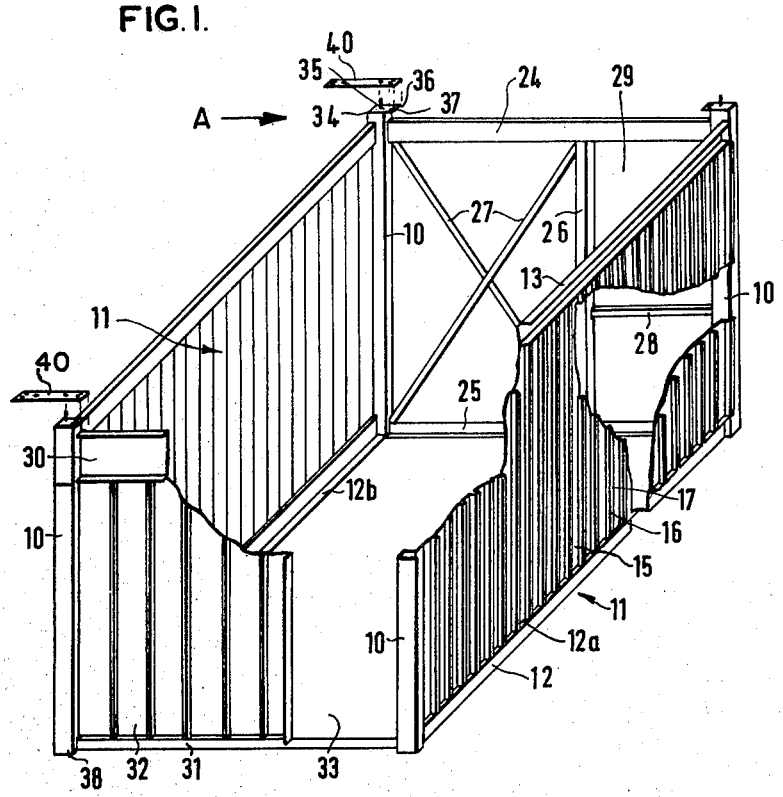
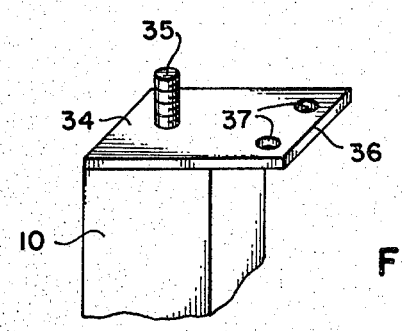
FIG. 1A.

ACCOMMODATION UNITS

BRIEF SUMMARY OF THE INVENTION

This invention relates to accommodation units for forming, with a multiplicity of such units, a building.

A building has been constructed from a plurality of box shaped metal housings secured together side-by-side and one on top of the other at their corners with in-fill concrete between adjacent sidewalls. The building was reliant on the structural strength of the housings and the concrete infill was intended principally to provide a fire barrier and sound deadening between adjacent units.

An object of the invention is to devise an accommodation unit which can be erected with other such units to form a building in which the initial concrete can contribute to the structural strength of the building as a whole.

The invention provides an accommodation unit for forming, with a multiplicity of such units, a building comprising a box shaped metal housing having four upright corner posts for attachment to corner posts of adjacent units and at least one side wall extending between one pair of corner posts and having ribs extending over the outer surface of the side wall, which ribs are formed with heads spaced from the wall to be enveloped and thereby form an integral rigid structure with an in-fill of a cast aggregate material between that side wall and an adjacent side wall of a further unit.

The unit may have such side walls on both sides thereof or may have a side wall on one side only thereof.

Preferably the panels of the side wall extend vertically and the T-section ribs of the panel extend vertically.

A ceiling may be mounted on the upper sides of the channel section on either side of the housing.

For example the ceiling may comprise a plurality of panels having T-section ribs on the upper side thereof to be enveloped in a cast aggregate cladding provided on the upper surface of the ceiling for providing a fire proof membrane.

Preferably the panels of the ceiling extend transversely across the housing.

The posts at one end of the unit may be connected at the upper and lower ends thereof by cross members and a window frame may be mounted in the end of the unit with bracing also provided to render the end rigid.

The corner posts at the other end of the housing may be connected by upper and lower cross-members and a bulk-head may extend part way across the end of the housing with a doorway to provide access to and from the unit.

BRIEF DESCRIPTION OF THE DRAWINGS

FIG. 1 is a perspective view of a basic accommodation unit according to the invention;

FIG. 1A is an enlarged detailed view of a part of the unit of FIG. 1 indicated by arrow A in FIG. 1;

DETAILED DESCRIPTION

Figure 2:
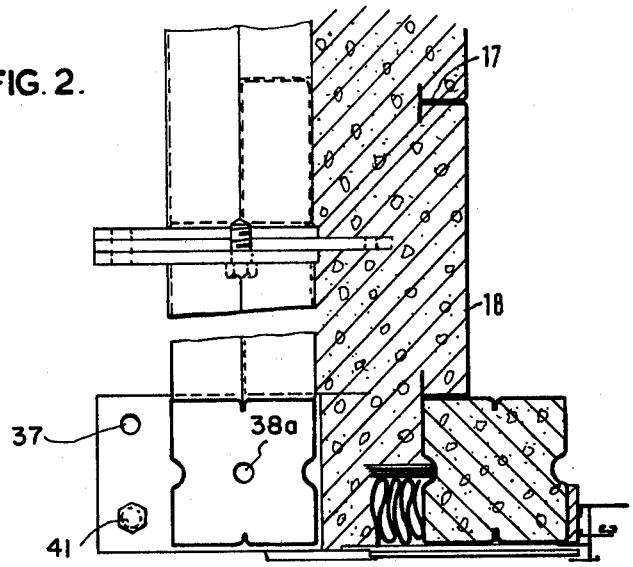
FIG. 2 is a horizontal section through parts of two adjacent accommodation units.

Referring firstly to FIG. 1 of the drawings, there is shown an accommodation unit which, with a multiplicity of such units, forms a building. The accommodation units can be located side-by-side to form a row of the required length and stacked vertically one on the other to provide the required number of storeys.

The accommodation unit as illustrated in FIG. 1 of the drawings comprises a box shaped housing formed in metal having four upright hollow generally square section corner posts 10 between which side walls indicated generally at 11 extend. Each side wall has a lower Z-section member 12 secured at its ends to the corner posts 10 and having an upper outwardly extending flange 12*a* and a lower inwardly extending flange 12*b*. The upper end of the side wall has a channel section member 13 extending between and secured to the corner posts. The side wall is completed by a number of vertically extending metal panels 15 extending between the members 12 and 13, each panel having L-section flanges 16 extending along the side edges thereof. The flanges of adjacent panels abut one another and are secured together by spot welding or rivetting and form vertically extending T-section ribs 17 on the outer sides of the side walls 11.

Figure 3:
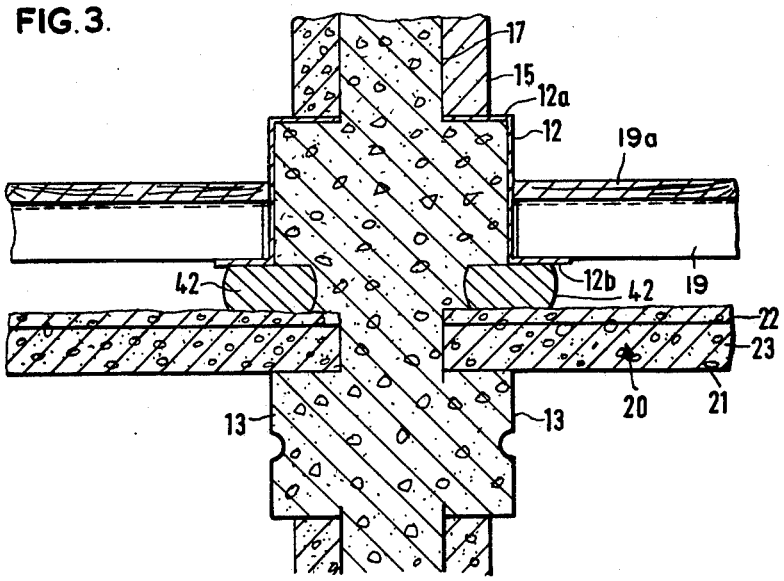
FIG. 3 is a vertical section through parts of adjacent accommodation units.

As can be seen in FIGS. 2 and 3 of the drawings and described in greater detail later, a cast concrete in-fill 18 is provided between adjacent side walls of two side-by-side accommodation units and the T-section ribs 17 formed by the flanges key into the concrete 18 to form a rigid composite structure between the side walls and concrete and to provide fire proofing and sound insulation between adjacent modules.

As can be seen in FIG. 3 of the drawings, the lower inwardly extending flanges 12*b* of the Z-shaped members 12 support a galvanized steel corrugated floor 19 which may be provided with a chipboard surface 19*a* secured by adhesive and screws to the peaks of the corrugations.

The upper members 13 of the side walls carry a ceiling panel or panels 20 which lie on the top of the members 13 and are secured thereto by rivetting or spot welding. The ceiling 20 is formed from a plurality of panels 21 similar to the panels 15 forming the side walls and the ribs 22 formed between adjacent panels 21 are located on the upper side of the ceiling. An overlay of lightweight concrete 23 is cast over the surface of the ceiling panels 21 to provide fire protection between vertically adjacent modules and also to dampen noise transmitted from one module to the vertically adjacent module.

Referring again to FIG. 1 of the drawings, at one end of the housing the corner posts 10 are connected by an upper cross member 24 and a lower cross member 25 secured to lugs on the posts by bolts (not shown). A vertical member 26 connects the upper and lower members part way between the posts 10. To one side of the member 26 there is diagonal cross bracing 27 to render the end of the housing rigid. The space between the upright 26 and posts 10 occupied by the diagonal bracing 27 is covered over by non-structural trim panels. On the other side of the member 26, there is a cross member 28 rigidly connecting the member 26 to the post 10 and defining, above the member 28 an aperture 29 for a window unit. The space below the member 28 is filled in with non-structural trim panels.

The other end of the housing has, at the upper ends of the posts 10 a heavy section cross member 30 joining the upper ends of the posts and a rather lighter section 31 joining the lower ends of the posts. Vertical panelling 32 similar to the panels 15 extend between the upper and lower cross members part way across the end of the housing leaving a doorway 33 for access to and from the accommodation unit.

As shown in FIGS. 1 and 1A, the head of each post 10 has a head plate 34 mounted thereon formed with an upwardly projecting screw threaded stud 35 which lies on a centre line extending through the post 10. The plate 34 has a lateral extension 36 extending to one side of the post 10 across the housing and provided with two spaced bolt holes 37.

The lower end of each post 10 has a similar foot plate 38 except that the screw threaded stud 35 is omitted and, in its place, there is an opening 38*a* to receive a stud 35 at the head of the post below.

Figure 5:
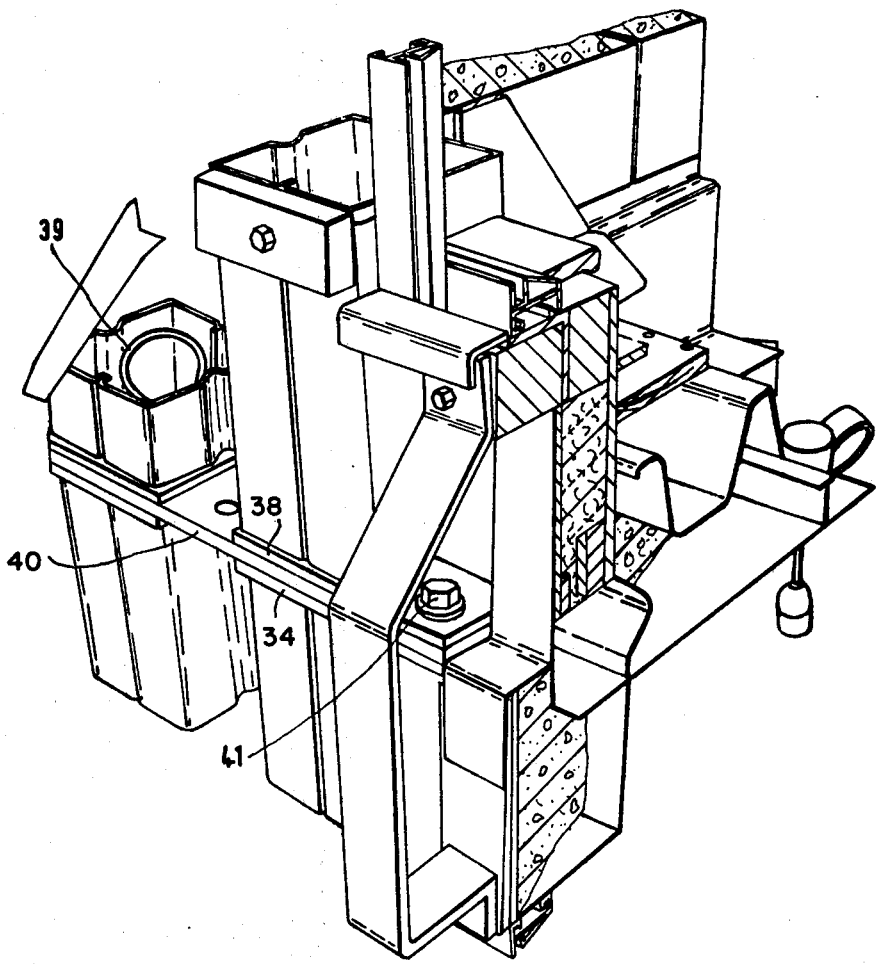
FIG. 5 also is a detailed sectional view of the junction, but as seen from a different side.

The screw threaded studs at the upper ends of the posts provide convenient attachments for lifting eyes 39 to be screwed on to the upper ends of the posts (see FIG. 5) for lifting an accommodation unit by crane during erection of a set of units. When the unit has been lifted and located in place, the lifting eyes are removed. The accommodation units are arranged side-by-side with one another and a tie plate 40 is located on the head plates of the corner posts 10 of adjacent modules. Each tie plate 40 has a pair of spaced holes to receive the upwardly projecting studs 35 for the two corner posts and has a further pair of holes adjacent each end of the tie plate to receive bolts passed through holes 37 in the lateral extensions 36 of the two head plates. When the next row of accommodation units is superimposed on the first row to be assembled, the foot plates of the accommodation units seat on the tie plates, with the studs 35 engaging in the apertures 38*a* in the foot plates 38 and then the foot plates of the upper posts are bolted through the tie plate to the head plates of the lower post by bolts 41 as can be seen in FIG. 5. The structure is then rendered rigid and is then ready for the insertion of the in-fill concrete 18 to be cast between adjacent side walls of the accommodation units.

A structural reinforced cross wall is formed by the cast in fill of concrete 18 between adjacent side walls 11 and the T-section ribs 17 on the side walls embedded in the concrete. The strength of the sidewall can be varied in accordance with the height of the structure to be erected by varying the quality of the concrete and, further, additional reinforcement for the concrete can be provided where necessary. Such additional reinforcement can be attached to T-section ribs of the side walls or to the upper and/or lower members of the side-walls.

Figure 4:
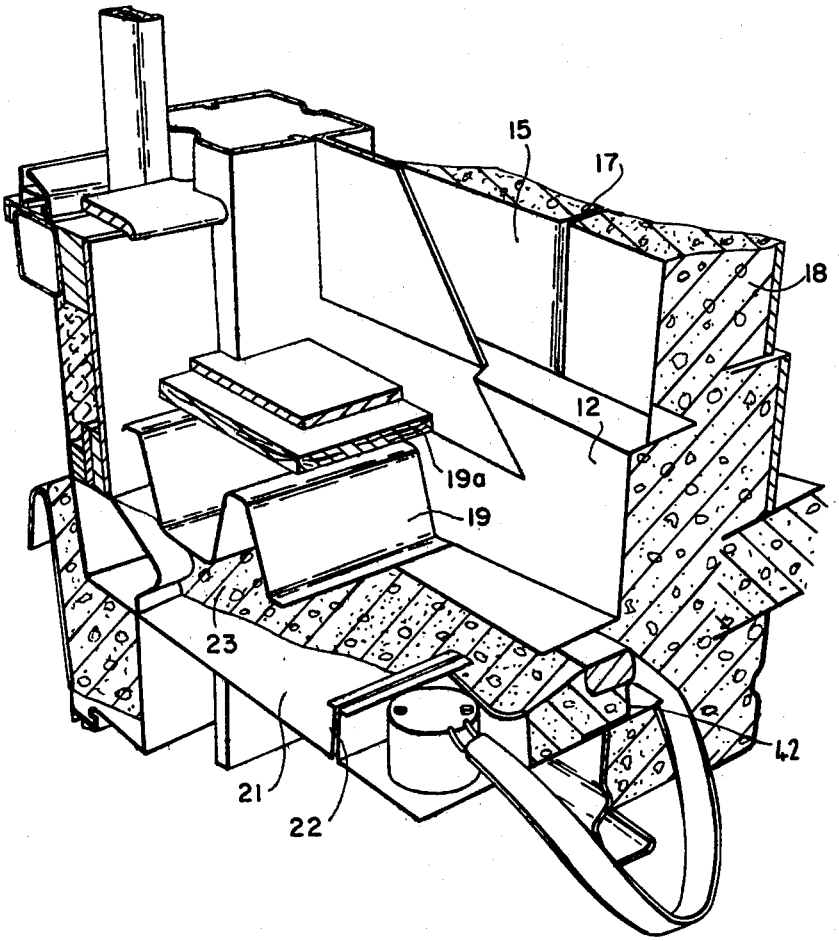
FIG. 4 is a detailed sectional view of a junction of four such accommodation units.

To limit the flow of the concrete into the voids between the ceilings 20 of the accommodation units and the floors 19 of the accommodation units above, foam or resilient compression strips 42 are accurately located along the sides of the lightweight concrete overlay 23 to engage the underside of the floor of the unit above as shown in FIGS. 3 and 4.

The accommodation units can be fully fitted out internally and externally with all the necessary services required for their intended purpose at the factory, leaving only the final connecting up of the services to common supply and disposal services as required on site. For example the accommodation units can be fully fitted out to include a bedroom and a bathroom with electrical supply and plumbing as required. Alternatively the accommodation units could be fitted out to provide Offices, Private Dwellings, Hospitals or Dormitories. Where a larger area than that provided by one accommodation unit is required, the panels 15 of side walls between two adjacent accommodation units or between a number of adjacent units, can be omitted.

Corridors and staircases or lifts between the floors of the building are provided as required or can be accommodated in similar units.

Figure 6:
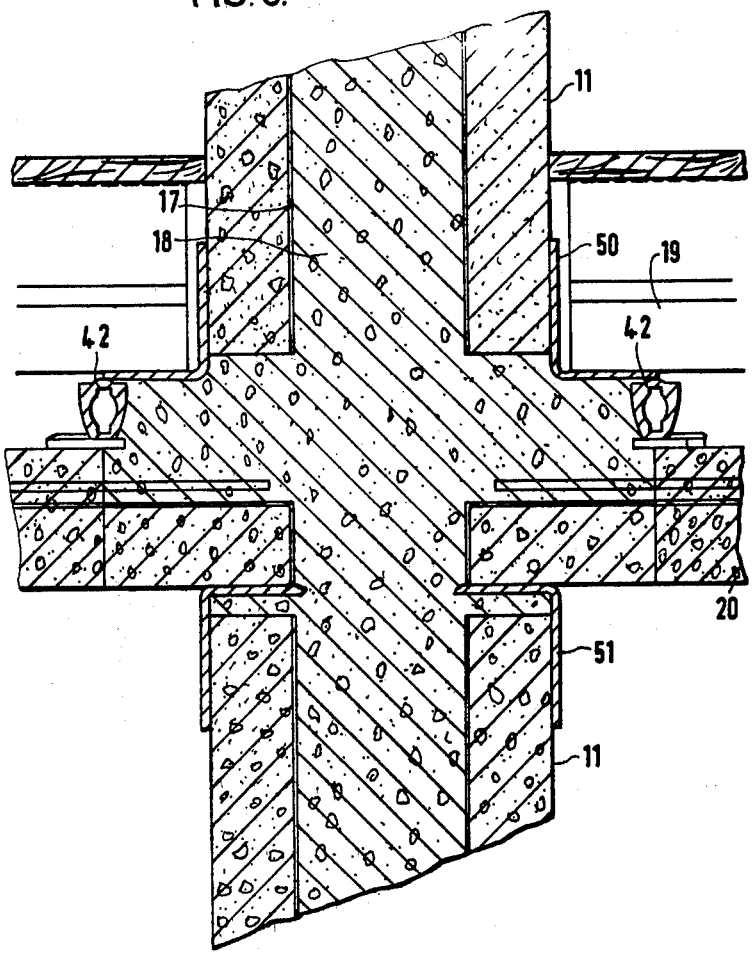
FIGS. 6 to 11 show further embodiments.
Figure 7:
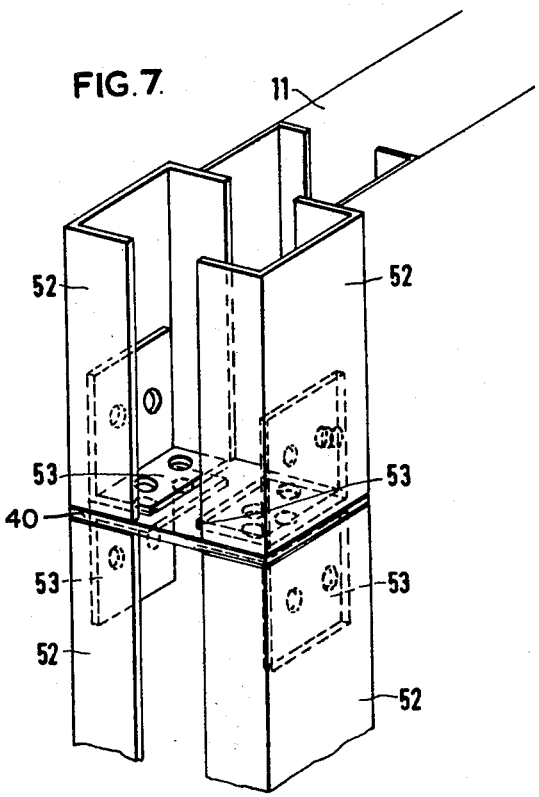
Figure 8:
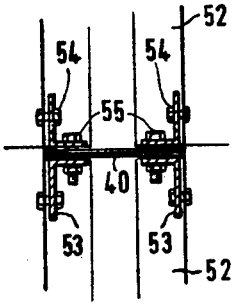

Reference is now made to FIGS. 6 to 8 which show details of a modified form of construction of the housing. Firstly the Z-section members 12 along the lower edges of the housing walls are replaced by simple angle sections 50 the upright limbs of which are secured to the side walls 11 of the housing. The lower limbs of the angle sections 50 extend inwardly across the housing and support the corrugated floor 19 of the housing. Likewise the upper channel section members 13 extending along the tops of the side walls 11 are replaced by angle section members 51 each having a vertical limb secured to a side wall 11 of the housing and a horizontal outwardly extending limb on which the ceiling panels 20 of the housing rest. A further difference is that the hollow generally square-section corner posts 10 of the housing are replaced by simple outwardly facing channel sections 52 secured to the upright ends of the side walls 11. Brackets 53 are bolted within the channels at the upper and lower ends thereof by bolts 54. The brackets of vertically adjacent channels are secured together by bolts 55 with a tie plate 40 extending from the joint between one pair of channels to the joint between the laterally adjacent pair of channels to tie the two housings rigidly together. The remaining details and manner of erection of the housing are similar to those of the first embodiment described above.

Figure 9:
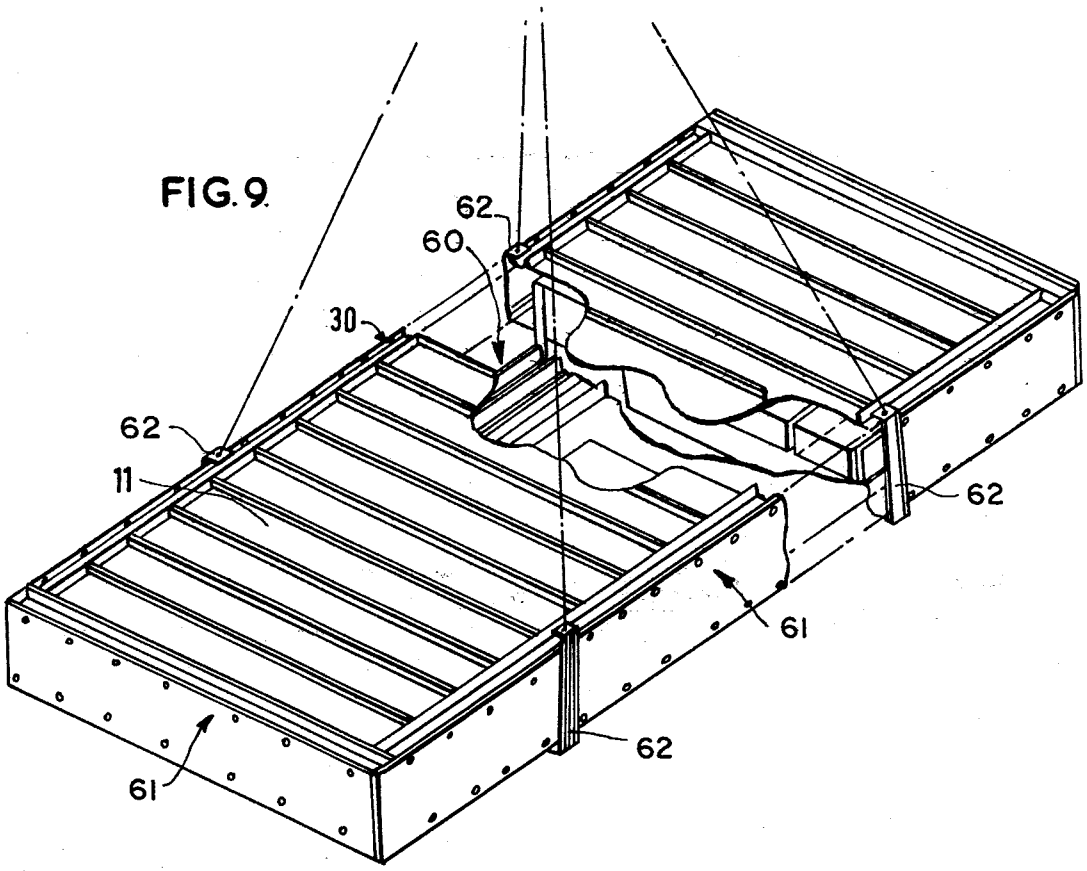

To facilitate the transport of an accommodation unit, a kit of parts of the unit may be assembled as a crate as shown in FIG. 9 comprising the two side walls 11 spaced one above the other with a space 60 between the walls for all the remaining components of the unit including the floor and ceiling panels, cross-members, other panels of the ends of the housing and all the necessary internal fittings required. The perimeters of the two side walls are connected by bolted on plywood panels 61. At suitable slinging and supporting points, struts 62 in either timber or steel are secured to the side walls to enable the crate to be lifted by normal methods such as slinging or hooks. The struts having bearing points at the top and bottom thereof to enable stacks of crates to be erected and bolted or lashed together in convenient heights and weights for transporting and shipping. The arrangement of the kit of parts thus provides a convenient way of transporting an accommodation unit occupying the minimum space with the side walls of the unit protecting all the remaining components of the unit and the unit can then be readily assembled on or near the site of the required building.

Figure 10:
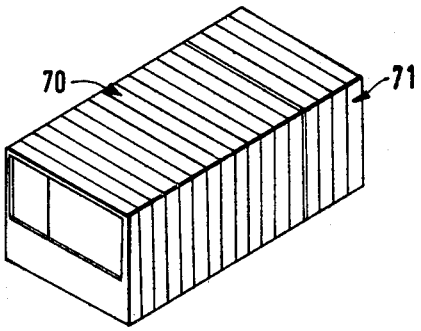
Figure 11:
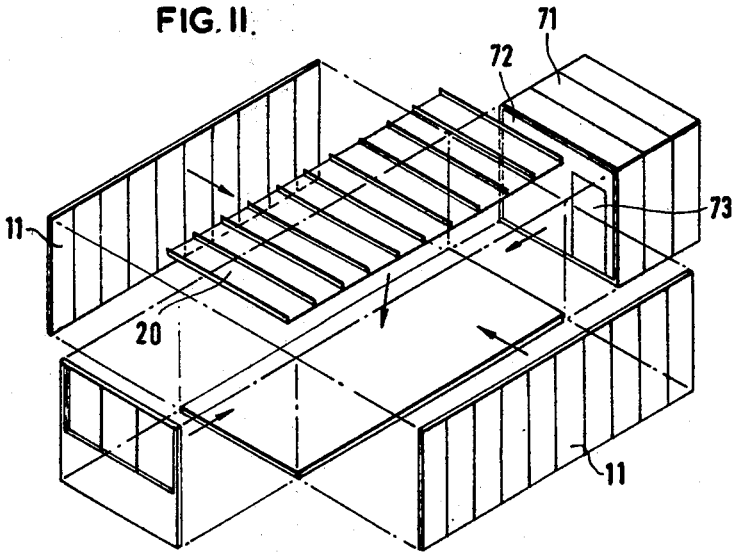

A further arrangement is illustrated in FIGS. 10 and 11 to which reference will now be made. The accommodation unit comprises a main section 70 and a short end section 71. The end section 71 is factory built and includes all the necessary services for the unit. End section 71 has at both ends thereof a bulk-head, one of which can be seen at 72 and each provided with doorways as at 73. The main section 71 of the unit is supplied in component form for erection on site. The end section 71 can be delivered with items such as furnishings and loose furniture for the unit stored in the section. Heavier structural parts of the unit such as the window, sides, ceiling, decking and flooring panels can also be transported housed in the end section or can be separately delivered. The components used for the side walls, ends, floors and ceiling are as described with reference to the two previous embodiments and the parts of the main section can easily be part-bolted, part spot-welded together on site to form a complete unit as described earlier ready for erecting. The building up of the services for the unit in a separate section in a factory enables the more difficult assembly work of the unit to be carried out under factory conditions providing better quality control over the construction of the unit.

I claim:

1. A building comprising:

a plurality of accommodation units, each said unit comprising a box-shaped metal housing formed by:
- four upright corner posts for attachment to the corner posts of adjacent units;
- at least one side wall extending between one pair of said corner posts;
- said side wall having an outer surface having ribs extending outwardly therefrom; and
- said ribs having heads spaced outwardly from said side wall;

said units being arranged such that spaces separate adjacent said side walls of adjacent pairs of said units;

said spaces being filled with a cast aggregate material to envelop said ribs and said heads, thereby forming an integral rigid structure including said adjacent side walls and said cast aggregate material therebetween.

2. A building as claimed in claim 1, wherein said unit has said side walls formed with said ribs on both sides thereof.

3. A building as claimed in claim 1, wherein said unit has said side wall on one side only thereof.

4. A building as claimed in any of claims 1, 2 or 3, wherein each said side wall comprises a plurality of parallel extending panels each having L-shaped flanges along the respective side edges thereof, the flanges of adjacent panels abutting one another to form said ribs having a T-shaped configuration on the outer surface of the panels to be enveloped in said cast aggregate material.

5. A building as claimed in claim 4, wherein said panels of said side wall extend vertically so that said T-shaped ribs formed by said panels extend vertically.

6. A building as claimed in any of claims 1, 2 or 3, wherein said housing has inwardly facing angle section members extending between the lower ends of said corner posts along the sides of said housing, said side wall of said housing being secured to an upright limb of said angle section member and a horizontal limb of said angle section member providing, with a corresponding limb on an opposite side of said unit, a support for a floor for said unit.

7. A building as claimed in any of claims 1, 2, or 3, wherein said housing has Z-shaped members extending between the lower ends of said corner posts along the sides of said housing; an upper flange of each Z-shaped member extending outwardly and receiving the lower end of said side wall, and a lower flange of each said Z-shaped member extending inwardly to support a floor for said housing.

8. A building as claimed in claim 7, wherein said floor comprises at least one corrugated panel extending between said Z-shaped members, said panel resting on said inwardly extending flanges of said members.

9. A building as claimed in any of claims 1, 2 or 3, wherein the upper ends of the pair of corner posts spaced along each side of said housing are connected by outwardly facing angle sections, said side wall of said housing being secured to a vertical limb of said angle section, and a horizontal limb of said angle section supporting a ceiling for said housing.

10. A building as claimed in any of claims 1, 2 or 3, wherein the upper ends of the pair of corner posts spaced along the sides of said housing are connected by outwardly facing channel sections, the upper ends of said side walls being secured to said channel sections, and top flanges of said channel sections providing support for a ceiling panel for said unit.

11. A building as claimed in claim 9, wherein said ceiling is mounted on said sections between the upper ends of the corner posts on either side of said housing.

12. A building as claimed in claim 11, wherein said ceiling comprises at least one panel having spaced on the upper side thereof T-shaped ribs extending across said panel, said ribs being enveloped in a cast aggregate cladding provided on the upper surface of said ceiling.

13. A building as claimed in claim 12, wherein said ceiling is formed from a plurality of panels having L-shaped flanges along their side edges, the L-shaped flanges of adjacent said panels abutting one another and forming said T-shaped ribs on said upper surface of said ceiling.

14. A building as claimed in claim 13, wherein said panels of said ceiling extend transversely across said housing.

15. A building as claimed in any of claims 1, 2 or 3, wherein said corner posts of a first end of said unit are connected at the upper and lower ends thereof by cross-members, a window frame is mounted in said end of said unit, and bracing is also provided to render said end rigid.

16. A building as claimed in claim 5, wherein said corner posts at a second end of said housing are connected by upper and lower cross-members, and a bulk head extends part-way across said second end of said housing with a door to provide access to and from said unit.

17. A building as claimed in any of claims 1, 2 or 3, wherein said corner posts comprise outwardly facing channel sections, and brackets are secured to the upper and lower ends of each said corner post for attachment of said unit to a vertically and/or laterally adjacent unit.

18. A building as claimed in any of claims 1, 2 or 3, wherein said corner posts are box-shaped sections having head and foot plates at the upper and lower ends thereof for attachment of said unit to a vertically and/or laterally adjacent unit.

* * * * *